US006718151B2

(12) United States Patent
Kibune et al.

(10) Patent No.: US 6,718,151 B2
(45) Date of Patent: Apr. 6, 2004

(54) IMAGE FORMATION APPARATUS AND METHOD OF ALTERNATING DEVELOPING UNITS

(75) Inventors: Hideaki Kibune, Tokyo (JP); Nobuyuki Yanagawa, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 22 days.

(21) Appl. No.: 10/155,088

(22) Filed: May 28, 2002

(65) Prior Publication Data

US 2002/0186987 A1 Dec. 12, 2002

(30) Foreign Application Priority Data

May 28, 2001 (JP) ..... 2001-159480

(51) Int. Cl.[7] ..... G03G 15/01
(52) U.S. Cl. ..... 399/228
(58) Field of Search ..... 399/228, 231, 399/223, 222

(56) References Cited

U.S. PATENT DOCUMENTS

| | | | | |
|---|---|---|---|---|
| 4,647,961 A | | 3/1987 | Kammoto et al. | |
| 4,841,358 A | | 6/1989 | Kammoto et al. | |
| 4,968,997 A | | 11/1990 | Saitoh et al. | |
| 5,194,959 A | | 3/1993 | Kaneko et al. | |
| 5,404,206 A | | 4/1995 | Andoh et al. | |
| 5,915,074 A | * | 6/1999 | Shimazawa et al. | 395/104 |
| 6,157,797 A | | 12/2000 | Saito et al. | |
| 6,215,974 B1 | | 4/2001 | Katoh et al. | |
| 6,256,461 B1 | | 7/2001 | Takeyama et al. | |
| 6,263,178 B1 | * | 7/2001 | Takeyama et al. | 399/228 |
| 6,292,641 B1 | * | 9/2001 | Takeyama et al. | 399/228 |
| 6,308,027 B1 | | 10/2001 | Obu et al. | |

FOREIGN PATENT DOCUMENTS

| | | |
|---|---|---|
| JP | 10-177286 | 6/1998 |
| JP | 11-109708 | 4/1999 |
| JP | 11-125968 | 5/1999 |

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An image formation apparatus has photo conductor drums, and upstream developing rollers and downstream developing rollers that are brought into contact with respective photo conductor drums based on a changeover. The developing rollers develop latent images into visual images. A time required to change over a developing unit from one developing unit to the other developing unit is set as follows. A changeover time T2 from the downstream developing rollers to the upstream developing rollers respectively is set shorter than a changeover time T1 from the upstream developing rollers to the downstream developing rollers.

9 Claims, 4 Drawing Sheets

IMAGE FORMATION APPARATUS AND METHOD OF ALTERNATING DEVELOPING UNITS

FIELD OF THE INVENTION

The present invention relates to a technology used when forming image(s), in for example printers or plane paper copying machines ("PPC's"), with an improvement in the driving of a developing unit.

BACKGROUND OF THE INVENTION

Examples of prior art of this type of technology are as follows. A method of and an apparatus for forming image has been disclosed in Japanese Patent Application Laid-Open No. 10-177286, an image formation apparatus has been disclosed in Japanese Patent Application Laid-Open No. 11-109708, and a method of and an apparatus for forming image has been disclosed in Japanese Patent Application Laid-Open No. 11-125968. According to the structures described in these publications, two image stations are disposed around an intermediate transfer unit. Two developing units are disposed in each photo conductor provided in each image station. These two developing units are changed over between them to form visible images of different colors on the photo conductor. Visible images prepared on the two photo conductors respectively are sequentially transferred in superimposition onto the intermediate transfer unit. A visible image obtained based on the superimposed transfer is transferred again onto a paper to form a color image.

Japanese Patent Application Laid-Open No. 10-177286 points out various problems that the image formation apparatus becomes large, that the number of printed sheets per unit time is small, and that the apparatus requires many image processing units.

In order to solve these problems, the invention disclosed in this publication has the following structure. The image formation apparatus has an intermediate transfer belt onto which a toner image on a photo conductor drum is transferred, and a transfer unit that transfers a color image on the intermediate transfer belt onto a transfer paper. In the above structure, first and second image formation units are disposed, with a distance between them, along the intermediate transfer belt. On the first image formation unit, there are provided one photo conductor drum, a developing unit that develops an electrostatic latent image on the photo conductor drum with a toner of color A, and a developing unit that develops this electrostatic latent image with a toner of color B. On the second image formation unit, there are provided one photo conductor drum, a developing unit that develops an electrostatic latent image on the photo conductor drum with a toner of color C, and a developing unit that develops this electrostatic latent image with a toner of black color.

According to Japanese Patent Application Laid-Open No. 11-109708, two developing units are disposed on each photo conductor provided in each of two image stations that are disposed around the intermediate transfer unit. These two developing units are changed over between them to form visible images of different colors on the photo conductor. Visible images prepared on the two photo conductors respectively are sequentially transferred in superimposition onto the intermediate transfer unit. A visible image obtained based on the superimposed transfer is transferred again onto a paper to form a color image. It is an object of this invention to provide a changeover unit that changes over between the developing units in this image formation apparatus.

In order to meet this object, the invention of this publication provides one development driving system that drives the two developing units, and a changeover unit that changes over the power of the development driving system to anyone of the two developing units, in each image station.

Japanese Patent Application Laid-Open No. 11-125968 describes a structure that two developing units are disposed adjacently which face the external periphery of the image holder. One developing unit develops a latent image on the image holder into a visible image of an optional color. The other developing unit develops the same latent image on the same image holder into a visible image of a color different from the color used by the former developing unit. According to this structure, the developing units that develop the latent images into visible images are changed over between them during the rotation of the image holder, thereby to change over colors. The invention of this publication has an object of providing margin in the developing unit changeover time at the time of sequentially developing the latent images into visible images using two colors.

In order to meet this object, according to the invention of this publication, a developing unit positioned at an upstream in the rotation direction of the image holder (an upstream developing unit) first starts development out of the two developing units. A developing unit positioned at a downstream (a downstream developing unit) starts development next.

According to the image formation method disclosed in the above publication, changing over a developing unit to be used for carrying out development from the downstream developing unit to the upstream developing unit (hereinafter, to be referred to as a changeover of a developing function) has the following problem. A time taken from when the end of an image that has been first developed into a visible image has passed through a developing unit that has carried out this development till when the start of the next latent image to be developed into a visible image by the other developing unit reaches the developing unit that is to develop this latent image, becomes shorter than the time taken when the developing unit is changed over from the upstream developing unit to the downstream developing unit.

Therefore, according to the invention described in Japanese Patent Application Laid-Open No. 11-125968, after the upstream developing unit has first carried out the image formation, the developing function is changed over to downstream the developing unit. Based on this, margin is provided in the time of changing over the developing function.

However, the above conventional technique has had the following problems.

Often, the image formation apparatus outputs a plurality of images continuously. Therefore, a high-speed printing has been desired for this continuous output. For carrying out a continuous output, it is necessary to alternately execute the changeover of the developing function from the upstream developing unit to the downstream developing unit, and the changeover of the developing function from the downstream developing unit to the upstream developing unit. It is necessary to execute this change over continuously.

Therefore, it is necessary to accommodate the time required for the changeover of the developing function within a shorter period of time out of the developing function changeover times in both directions. It is difficult to provide margin in the developing function changeover times. When it is not possible to accommodate the developing function changeover time within a shorter changeover time, it is necessary to increase the peripheral length of the intermediate transfer belt. However, increasing the peripheral length of the intermediate transfer belt becomes a large hindrance to the increasing of the print speed, and reducing the sizes and lowering the cost of the image formation apparatus.

SUMMARY OF THE INVENTION

It is an object of the present invention to provide an image formation apparatus and an image formation method capable of realizing a high-speed printing, and a size reduction and cost reduction of the apparatus.

The image formation apparatus according to one aspect of the present invention comprises an image holder, a first developing unit, and a second developing unit, wherein a latent images on the image holder is developed by changing over between the first developing unit and the second developing unit. Out of the first developing unit and the second developing unit, a changeover time T2 to change over from a developing unit positioned at a downstream in a rotation direction to a developing unit positioned at an upstream in the rotation direction of the image holder is set shorter than a changeover time T1 to change over a developing unit from the developing unit positioned at an upstream in the rotation direction to the developing unit positioned at a downstream in the rotation direction.

The image formation method executed on an image formation apparatus that comprises a first developing unit and a second developing unit, and that develops latent images on an image holder using the first developing unit and the second developing unit. The image formation method comprises developing a latent image on the image holder using a developing unit positioned at an upstream in the rotation direction of the image holder, out of the first developing unit and the second developing unit, changing over a developing unit used for development from a developing unit positioned at an upstream in the rotation direction of the image holder to a developing unit positioned at a downstream in the rotation direction of the image holder over a changeover time T1, developing a latent image on the image holder using the developing unit positioned at a downstream in the rotation direction of the image holder, and changing over a developing unit used for development from the developing unit positioned at a downstream in the rotation direction of the image holder to the developing unit positioned at an upstream in the rotation direction of the image holder over a changeover time T2 that is shorter than the changeover time T1.

Other objects and features of this invention will become apparent from the following description with reference to the accompanying drawings.

DETAILED DESCRIPTIONS

Embodiments of the present invention will be explained in detail below with reference to the accompanying drawings.

Figure 1:
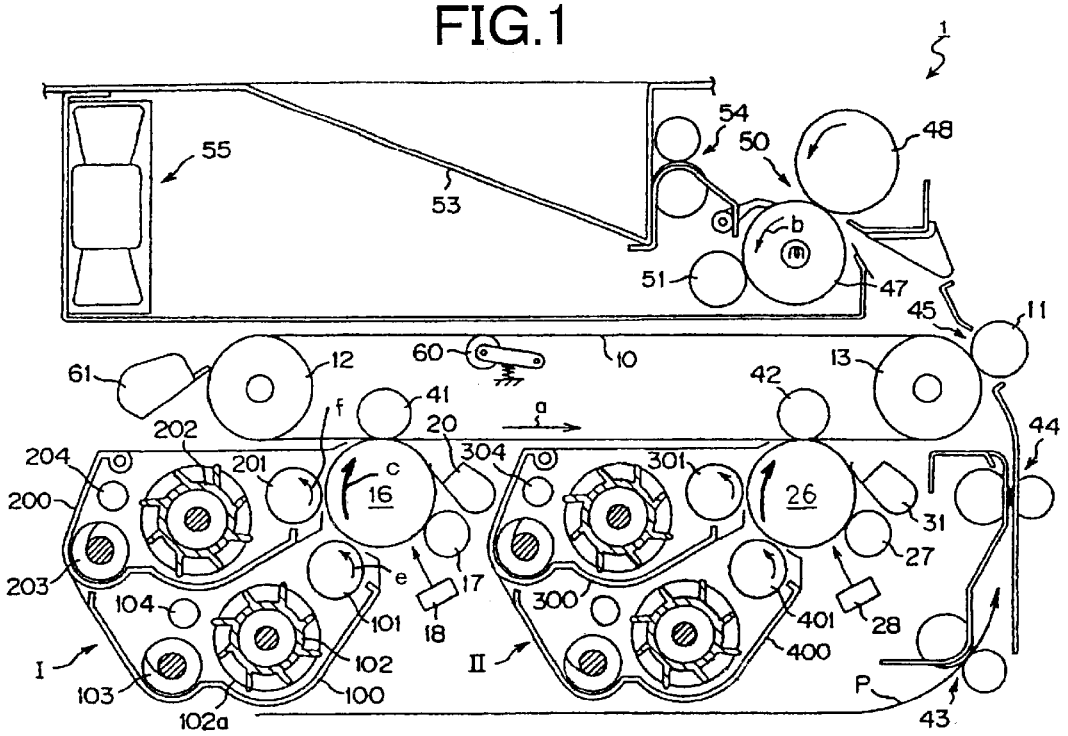
FIG. 1 is a diagram which shows a structure example of an image formation apparatus to which the present invention is applied.

A structure of an image formation apparatus to which the present invention is applied will be explained. FIG. 1 is a diagram which shows a structure example of an image formation apparatus to which the present invention is applied. In FIG. 1, an image formation apparatus 1 has an intermediate transfer belt 10 applied to between a driving roller 13 and a subordinate roller 12. The intermediate transfer belt 10 is driven to run in a direction of an arrow mark a by the driving roller 13.

The intermediate transfer belt 10 is being given an optimum tension by a tension roller 60. On the lower-side running surface of the intermediate transfer belt 10, a first image formation unit I and a second image formation unit II are disposed with a constant distance between these units, along the running direction of the intermediate transfer belt 10. The intermediate transfer belt 10 has a length larger than the length of a maximum-size transfer paper sheet used in the image formation apparatus 1 of the present embodiment by the length of a non-image area portion.

The first image formation unit I includes a charging unit 17 consisting of a roller that uniformly charges the surface of a photo conductor drum 16 as an image holder, a writing unit 18 that writes a latent image on the charged surface of the photo conductor drum 16 with a beam modulated by an image signal, a color A developing unit 100, a color C developing unit 200, and a cleaning unit 20. The photo conductor drum rotates in an arrow mark c direction.

The color A developing unit 100 includes a developing roller (to be referred to as an upstream developing roller as this developing roller is positioned at an upstream in the rotation direction of the photo conductor drum 16 as compared with a developing roller 201 to be described later) 101, a paddle roller 102, a screw conveyor 103, and a developing solution replenishment opening 104. The paddle roller 102 has a screw-shaped fin 102*a*, and rotates in one direction to stir the developing solution within the color A developing unit 100 while conveying the solution in the axial direction. The paddle roller 102 supplies the stirred developing solution to the upstream developing roller 101. The screw conveyor 103 conveys the developing solution within the color A developing unit 100 to a direction opposite to the conveying direction of the paddle roller 102. The developing solution within the color A developing unit 100 is supplied to the upstream developing roller 101 in the status that the developing solution has been sufficiently stirred by the paddle roller 102 and the screw conveyor 103.

The developing solution replenishment opening 104 is detachably mounted with a toner replenishment container (not shown). From the toner replenishment container, a color A toner is suitably replenished to one end portion of the screw conveyor 103, and the concentration of the developing solution within the color A developing unit 100 is maintained at a predetermined value. The color C developing unit 200 also includes a developing roller (to be referred to as a downstream developing roller as this developing roller is positioned at a downstream in the rotation direction of the photo conductor drum 16 as compared with the developing roller 101) 201, a paddle roller 202, a screw conveyor 203, and a developing solution replenishment opening 204. Structures and functions of these units are similar to those of the upstream developing roller 101, the paddle roller 102, the screw conveyor 103, and the developing solution replenishment opening 104 of the color A developing unit 100.

Figure 2:
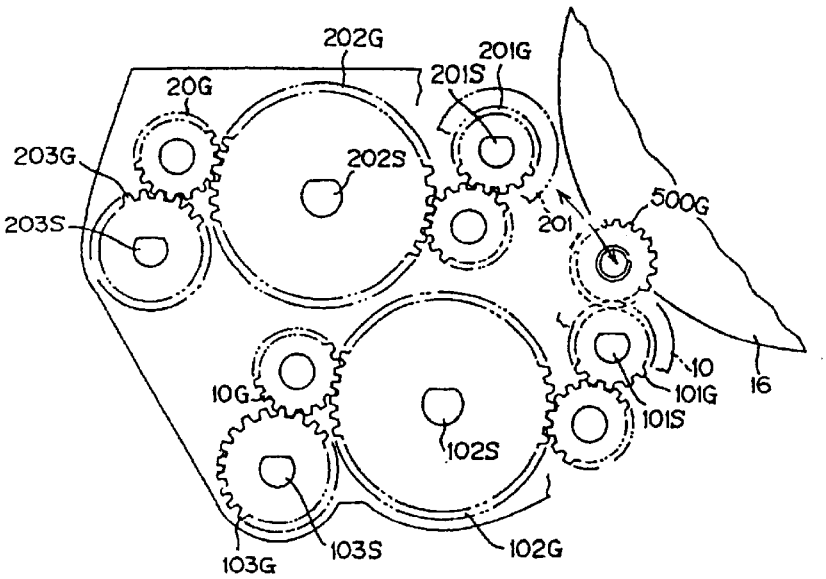
FIG. 2 is an explanatory diagram which shows one example of a linkage between a paddle roller and a screw conveyor.

A linkage between the paddle roller 102 and the screw conveyor 103 will be explained next. FIG. 2 is an explanatory diagram which shows one example of a linkage between the paddle roller and the screw conveyor. The paddle roller 102 and the screw conveyor 103 of the color A developing unit 100 are linked to each other, at the outside of one end plate of the color A developing unit 100, with gears 102G and 103G fixed to axes 102S and 103S of these rollers respectively, via an intermediate idle gear 10G.

Similarly, the paddle roller 102 and the upstream developing roller 101 are also linked to each other with the gear 102G and a gear 101G fixed to the axis 102S and an axis 101S of these rollers respectively, via an intermediate idle gear.

The paddle roller 202 and the screw conveyor 203 of the color C developing unit 200 are linked to each other with gears 202G and 203G fixed to axes 202S and 203S of these rollers respectively, via an intermediate idle gear 20G, as shown in FIG. 2.

Similarly, the paddle roller 202 and the developing roller 201 are also linked to each other with the gear 202G and a gear 201G fixed to the axis 202S and an axis 201S of these rollers respectively, via an intermediate idle gear.

When the upstream developing roller 101 rotates in an arrow mark e direction (refer to FIG. 1) based on the driving of a driving source, the paddle roller 102 and the screw conveyor 103 are driven to rotate. When the developing roller 201 rotates in an arrow mark f direction (refer to FIG. 1) based on the driving of the driving source, the paddle roller 202 and the screw conveyor 203 are driven to rotate.

In FIG. 2, a driving gear 500G is linked to a motor (not shown) provided as a driving source at the apparatus main body side, and the driving gear 500G is rotatably provided. When the driving gear 500G is engaged with the gear 101G or the gear 201G, the developing roller 101 or 201 rotates. In FIG. 2, as the driving gear 500G is engaged with the gear 101G, the upstream developing roller 101 rotates in the arrow mark e direction as shown in FIG. 1.

In FIG. 1, the second image formation unit II has a structure similar to that of the first image formation unit I. The second image formation unit II includes a photo conductor drum 26, a charging unit 27, a writing unit 28, a color B developing unit 300, a color D developing unit 400, and a cleaning unit 31. The second image formation unit II is installed in the apparatus main body in a posture similar to that of the first image formation unit I. The photo conductor drum 26 rotates in an arrow mark d direction.

Constituent elements of the second image formation unit II attached with the same reference symbols as those corresponding to the first image formation unit I will not be explained except where specified otherwise. The second image formation unit II also has a rotation transmission mechanism similar to that (refer to FIG. 2) of the first image formation unit I.

Both image formation units I and II are provided detachably on the apparatus main body. The rotation of each of the photo conductor drums 16 and 26 is synchronous with the running of the intermediate transfer belt 10, and the peripheral speed of each photo conductor drum has been set to strictly coincide with the running speed of the intermediate transfer belt 10. In place of the charging units 17 and 27, it is possible to employ charging units each consisting of a corona discharging unit or a brush.

The color A developing unit 100 and the color C developing unit 200 of the first image formation unit I accommodate a magenta toner and a cyan toner respectively. The color B developing unit 300 and the color D developing unit 400 provided in the second image formation unit II, that is the image formation unit located near a transferring section 45, accommodate a yellow toner and a black toner, respectively.

The black toner is used not only for a color copy but also for a monochromatic copy. Therefore, it is advantageous to provide the color D developing unit 400 in the second image formation unit II near the transferring section 45, in order to increase the copying speed at the time of making a monochromatic copy.

Electrostatic latent images are formed on the photo conductor drums 16 and 26 according to a known method (a uniform charging and a uniform writing) by the charging units 17 and 27 and the writing units 18 and 28 respectively. These electrostatic latent images are developed by the developing rollers 101, 201, 301, and 401 respectively. The four developing units 100, 200, 300, and 400 have mutually similar structures, and it is possible to employ known color developing units for them respectively.

The photo conductor drums 16 and 26 are separably provided with a first transfer roller 41 and a second transfer roller 42, each applied with a transfer bias current, to sandwich the intermediate transfer belt 10 between these drums and the rollers, respectively. The driving roller 13 is separably provided with a transfer roller 11, applied with a transfer bias voltage, via the intermediate transfer belt 10.

In the normal status, the photo conductor drums 16 and 26 are slightly separated downward from the intermediate transfer belt 10 respectively, and the first transfer roller 41 and the second transfer roller 42 are separated upward from the intermediate transfer belt 10 respectively. In the process of transferring toner images on the photo conductor drums 16 and 26 onto the intermediate transfer belt 10, the first transfer roller 41 brings the intermediate transfer belt 10 into contact with the photo conductor drum 16, and the second transfer roller 42 brings the intermediate transfer belt 10 into contact with the photo conductor drum 26, respectively.

The transferring section 45 has a structure of transferring color images with the driving roller 13 and the transfer roller 11. Corona discharging units or brush charging units may be employed in place of the first transfer roller 41 and the second transfer roller 42, as the transfer units. The subordinate roller 12 is separably provided with a cleaning device 61 that removes the toner remaining on the surface of the intermediate transfer belt 10, via the intermediate transfer belt 10.

At a lower position of the first image formation unit I and the second image formation unit II, there is disposed a paper feeding device (not shown) that feeds each sheet of transfer paper out of stacked sheets of transfer paper to a right direction in FIG. 1. A sheet of transfer paper P that has been fed out from the paper feeding device is supplied to the transferring section 45 by a pair of sending rollers 43 and a pair of resist rollers 44.

Diagonally above the transferring section 45, there is disposed a fixing device 50 consisting of a heating roller 47 that is driven to rotate in an arrow mark b direction, and a pressing roller 48 that rotates in pressure contact with the heating roller 47. A roller 51 that coats an offset preventing solution onto the surface of the heating roller 47 is brought into contact with the heating roller 47 according to the needs.

At a downstream of the fixing device 50, there are disposed a pair of paper discharging rollers 54 that feeds out a sheet of transfer paper sent out from the fixing device 50, onto a discharge paper tray 53. At a left upper position in FIG. 1, an exhaust fan 55 that exhausts air is provided, thereby to prevent the electric parts below the paper discharge tray 53 from being heated by the heated air of the fixing device 50.

Next, the operation of the image formation apparatus 1 having the above structure will be explained.

(1) First, the charging unit 17 and the writing unit 18 form an electrostatic latent image to be developed by the color A developing unit 100 on the photo conductor drum 16 of the first image formation unit I. The formed electrostatic latent image is developed into a visible image by the color A developing unit 100 to form a magenta toner image (hereinafter to be referred to as an image M) The image M is transferred onto the intermediate transfer belt 10 by the first transfer roller 41.

(2) Next, the intermediate transfer belt 10 runs in an arrow mark a direction. During a period while the image M approaches the second image formation unit II, the charging unit 27 and the writing unit 28 form an electrostatic latent image to be developed by the color B developing unit 300 on the photo conductor drum 26. The formed electrostatic latent image is developed into a visible image by the color B developing unit 300 to form a yellow toner image (hereinafter to be referred to as an image Y). The image Y is transferred onto the intermediate transfer belt 10 by the second transfer roller 42, in superimposition with the image M obtained by the first image formation unit I.

(3) While the superimposed image of the image M and the image Y approaches the first image formation unit I following the running of the intermediate transfer belt 10, the charging unit 17 and the writing unit 18 form an electrostatic latent image corresponding to the color C developing unit 200 on the photo conductor drum 16. This electrostatic latent image is developed into a visible image by the color C developing unit 200 to form a cyan toner image (hereinafter to be referred to as an image C). The image C is transferred onto the intermediate transfer belt 10 by the first transfer roller 41, in superimposition with the image M and the image Y.

(4) Last, while the superimposed image of the image M, the image Y, and the image C approaches the second image formation unit II following the running of the intermediate transfer belt 10, the charging unit 27 and the writing unit 28 form an electrostatic latent image corresponding to the color D developing unit 400 on the photo conductor drum 26. This electrostatic latent image is developed into a visible image by the color D developing unit 400 to form a black toner image (hereinafter to be referred to as an image BK). The image BK is transferred onto the intermediate transfer belt 10 by the second transfer roller 42, in superimposition with the image M, the image Y, and the image C.

When the color image is finally formed on the intermediate transfer belt 10, a sheet of transfer paper fed out from the paper feeding device is fed to the transferring section 45 by the pair of resist rollers 44. The color image is transferred onto the transfer paper by the transferring section 45. The color image transferred onto the transfer paper is fixed on the transfer paper by the fixing device 50. The transfer paper with the fixed color image is fed out to the discharge paper tray 53 by the pair of paper discharging rollers 54. The intermediate transfer belt 10 that has finished the transfer of the color image is cleaned by the cleaning unit 61 to remove to toner remaining on the intermediate transfer belt 10.

To obtain a plurality of sheets of printed paper, the following process is carried out. When the second image formation unit II transfers the superimposed image of the image M and the image Y onto the intermediate transfer belt 10, the first image formation unit I continues the transfer of the image M onto the intermediate transfer belt 10. The steps (1) to (4) are repeated.

As explained above, while any one of the two developing rollers 101 and 201 (or 301 and 401) within the image formation unit is rotating to develop an electrostatic latent image on the photo conductor drum, the other developing roller is stopped. The present embodiment employs known developing rollers each consisting of a nonmagnetic sleeve that rotates during a developing operation and a magnet that is disposed within this nonmagnetic sleeve as a developing roller.

While one developing roller is rotating to develop an electrostatic latent image on the photo conductor drum, it is necessary to prevent the mixing of colors due to a move of a developing solution on the other developing roller onto the photo conductor drum and due to a move of a developing solution on the photo conductor drum onto the other developing roller. In order to prevent this mixing of colors, it is necessary to arrange such that the developing solution on the non-operating developing roller that is not rotating is kept in non-contact status with the photo conductor drum.

The changeover of the developing function includes the time required for switching between a status that the magnetic brush is in contact with the developing roller and a status that the magnetic brush is not in contact with the developing roller. The switching between these two statues of contact and non-contact of the magnetic brush can be executed by inversely rotating the development roller sleeve, as disclosed in Japanese Patent Application Laid-Open No. 11-109708. A method for flattening the magnetic brush based on the rotation of the magnet inside the developing roller as described in Japanese Patent Application Laid-Open No. 10-177186 has also been known well. The time required for switching between the two statues of contact and non-contact of the magnetic brush is not at a significant level. The switching between the two statues of contact and non-contact of the magnetic brush becomes unnecessary, when a developing system of non-contact development according to the application of an AC development bias is employed.

In the image formation apparatus, the time of changing over between the rotation and the stopping of the developing roller gives a large influence to the time of changing over a developing function. This developing function changeover time is a time required to change over a developing roller to a developing roller to be used for the development (between the two developing rollers 101 and 201 (or between 301 and 401)). The developing function changeover time in the image formation apparatus of the present embodiment will be explained next.

Figure 3A:
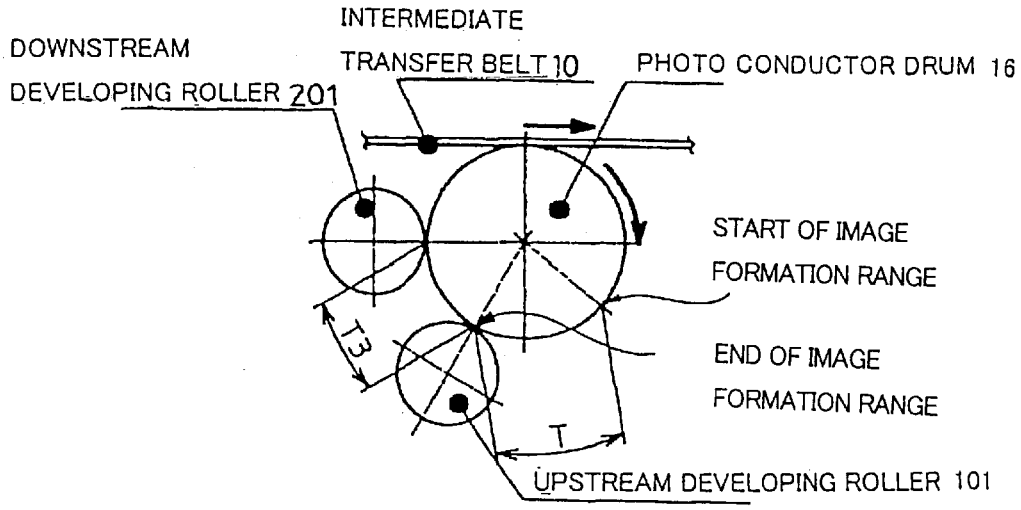
FIG. 3A and FIG. 3B are schematic structure diagrams of an image station which explain the operation of an image formation.
Figure 3B:
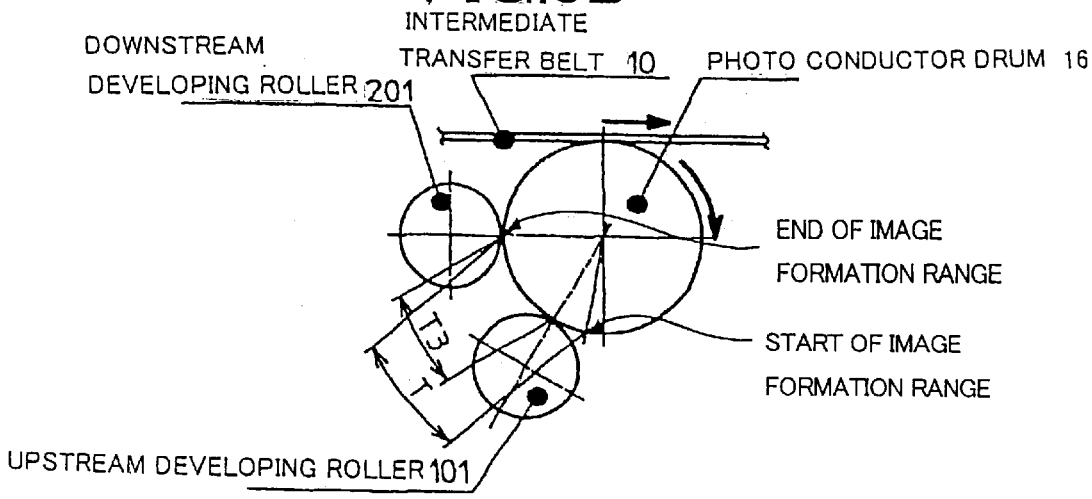

FIG. 3A and FIG. 3B are schematic structure diagrams of an image station which explain the operation of an image formation. Around the photo conductor drum 16 as the image holder, there are disposed developing rollers 101 and 201 as two developing units, and the intermediate transfer belt 10 as an intermediate transfer unit. The intermediate transfer belt 10 is used to sequentially transfer and superimpose visual images obtained by development of latent images on the photo conductor drum 16 by the developing rollers 101 and 201.

Time obtained by subtracting a time required for the intermediate transfer belt 10 to make one rotation by the image formation time will be expressed as T. A time required to change over a developing function from the upstream developing roller 101 to the downstream developing roller 201 will be expressed as T1. A time required to change over a developing function from the downstream developing roller 201 to the upstream developing roller 101 will be expressed as T2. A time required for the external periphery of the photo conductor drum 16 to move from a position in contact with the upstream developing roller 101 to a position in contact with the downstream developing roller 201 will be expressed as T3.

It is assumed that a developing function is changed over to the downstream developing roller 201 at the same time as when the end of an image formation range of the upstream developing roller 101 has reached the upstream developing roller 101. As is clear from FIG. 3A, the time T1 required for the downstream developing roller 201 to start development needs to be set as $T1<T+T3$.

Further, it is assumed that a developing function is changed over from the downstream developing roller 201 to the upstream developing roller 101 when the end of an image formation range of the downstream developing roller 201 has reached the downstream developing roller 201. As is clear from FIG. 3B, the time T2 required for the upstream developing roller 101 to start developing needs to be set as $T2<T-T3$.

When the time $T1=T2$, it is necessary to set that $T1=T2<T-T3$. Here, at the time of changing over a developing function from the upstream developing roller 101 to the downstream developing roller 201, it is necessary to execute the changeover during substantially a short period of time of $T-T3$, as compared with the original instance where T1 can take the time of $T+T3$. Further, at the time of determining the peripheral length of the intermediate transfer belt from the image output length and the developing function changeover time, it is necessary to determine the peripheral length of the intermediate transfer belt to match the changeover time of developing function from the downstream developing roller 201 to the upstream developing roller 101, even when there is sufficient time in the changeover time of developing function from the upstream developing roller 101 to the downstream developing roller 201. This becomes a large hindrance to the increasing of the print speed, reducing the sizes and lowering the cost of the image formation apparatus.

The image formation apparatus of the present embodiment employs a developing function changeover mechanism that can shorten the time required to change over a developing function from the downstream developing roller 201 to the upstream developing roller 101, by increasing the time to change over a developing function from the upstream developing roller 101 to the downstream developing roller 201. Based on this, an efficient developing function changeover operation is realized. Further, based on the employment of this developing function changeover mechanism, it becomes possible to reduce the peripheral length of the intermediate transfer belt.

In other words, the image formation apparatus 1 can efficiently execute the developing function changeover operation by setting the time relationship as $T2<T1<T2+2\times T3$. It is also possible to reduce the peripheral length of the intermediate transfer belt. It is possible to obtain the largest effect when the time relationship is $T1=T2+2\times T3$.

The developing roller rotation driving changeover mechanism employed in the image formation apparatus disclosed in Japanese Patent Application Laid-Open No. 11-109708 has the following structure. This mechanism is constructed of one development driving motor that drives two developing rollers, and a changeover mechanism that selectively changes over such that the power of the development driving motor is applied to one of the two developing rollers. This changeover mechanism has a structure that the rotation driving force changeover time from the upstream developing roller to the downstream developing roller in the rotation direction of the photo conductor becomes equal to the rotation driving force changeover time from the downstream developing roller to the upstream developing roller.

On the other hand, the image formation apparatus of the present embodiment employs the following structure. With respect to the developing roller rotation changeover time, the apparatus employs a rotation driving force changeover mechanism that can shorten the changeover time of rotation driving force from the downstream developing roller 201 to the upstream developing roller 101. This is achieved by increasing the time of changing over a developing roller from the upstream developing roller 101 to the downstream developing roller 201. With this arrangement, it is possible to realize efficient development driving force changeover operation, and reduce the peripheral length of the intermediate transfer belt.

In order to realize this operation, the driving force to realize the reduction of the changeover time from the downstream developing roller 201 to the upstream developing roller 101 is accumulated during the changeover operation from the upstream developing roller 101 to the downstream developing roller 201. The period has room for changeover time of the developing roller rotation driving force.

Figure 4:
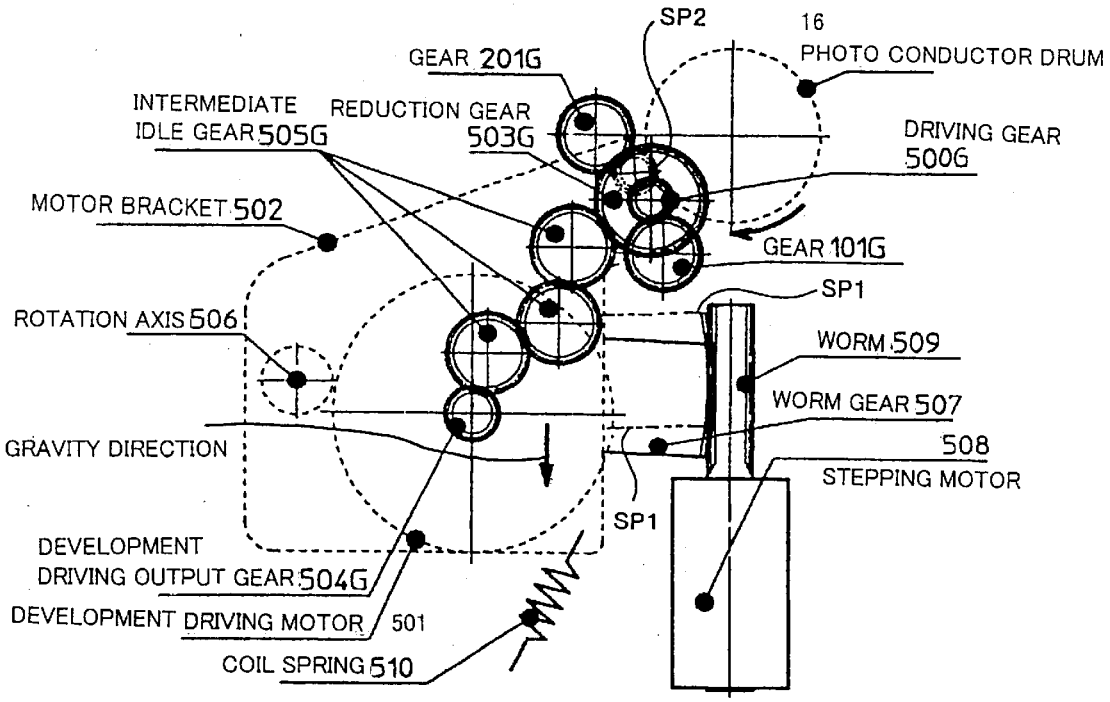
FIG. 4 is a structure diagram which explains the operation of accumulating the driving force to realize the operation of changing over from a downstream developing roller to an upstream developing roller in a shorter time.

A detailed structure for accumulating the driving force in the present embodiment will be explained next. FIG. 4 is a structure diagram which explains the operation of accumulating the driving force to realize the operation of changing over from the downstream developing roller to the upstream developing roller in a shorter time. In this drawing, gears 101G and 201G are provided coaxially with the rotation axis of two developing rollers 101 and 201 respectively that are disposed at the external periphery of a photo conductor drum 16. A development driving motor 501 that rotates the developing rollers is fixed on a motor bracket 502. On the motor bracket 502, there are rotatably supported a driving gear 500G that is selectively engaged with the gears 101G and 201G, and a reduction gear 503G that is coaxially integrated with the driving gear 500G.

A development driving output gear 504G is fixed to a driving output axis of the development driving motor 501. Between the development driving output gear 504G and the reduction gear 503G, there is formed a driving force transfer gear string by a plurality of intermediate idle gears 505G that are rotatably supported by the motor bracket 502. The motor bracket 502 is supported so as to be rotatable around a rotation axis 506, by a main body fixing section not shown.

A worm gear 507 formed around the rotation axis 506 is fixed to the motor bracket 502. A worm 509 that is engaged with the worm gear 507 is formed on an output axis of a stepping motor 508 that is fixed to the main body fixing section.

In the above structure, the stepping motor 508 is driven by a prescribed number of steps based on a position at which the driving gear 500G is engaged with the gear 101G as a reference. Then, the worm gear 507 engaged with the worm 509 rotates by a prescribed angle around the rotation axis 506 (a two-point chain line position, SP1). The motor bracket 502 rotates to a position at which the driving gear 500G is engaged with the other gear 201G (a two-point chain line position, SP2). Next, when the stepping motor 508 is driven to rotate inversely by a prescribed number of steps, the driving gear 500G is engaged with the gear 101G in a similar manner.

The motor bracket 502 receives a moment in the clockwise direction around the rotation axis due to gravity. Therefore, in order to change over the developing roller rotation driving force from the upstream developing roller 101 to the downstream developing roller 201, it is necessary to rotate the whole motor bracket 502 against the moment of gravity. At this time, the stepping motor 508 needs to output a high torque. Therefore, it is necessary to lower the driving frequency, and this requires a certain level of operation time.

When the developing roller rotation driving force is changed over from the downstream developing roller 201 to the upstream developing roller 101, potential energy is accumulated in the motor bracket 502 that rotates against gravity.

On the other hand, to change over the developing roller rotation driving force from the downstream developing roller 201 to the upstream developing roller 101, the whole motor bracket 502 is rotated in the same direction as that of the moment of gravity. At this time, the stepping motor 508 may output a low torque. Therefore, it is possible to increase the driving frequency, and the changeover operation in a short time is possible. The potential energy accumulated in the motor bracket is converted into the driving force for rotating the whole motor bracket 502 in the same direction as that of the moment of gravity. Consequently, it becomes possible to shorten the changeover time from the downstream developing roller 201 to the upstream developing roller 101.

In FIG. 4, when a coil spring 510 is disposed between the motor bracket 502 and the main body fixing section so that the motor bracket 502 receives the moment in the same direction as that of the moment of gravity, the above effect is further amplified. It is possible to realize the changeover from the downstream developing roller 201 to the upstream developing roller 101 in a shorter period of time. On the other hand, it requires a longer period of time to change over from the upstream developing roller 101 to the downstream developing roller 201.

At the time of changing over from the upstream developing roller 101 to the downstream developing roller 201, elastic energy is accumulated in the motor bracket 502 based on spring force of the coil spring 510 that has been disposed to receive the moment in the same direction as that of the moment of gravity. The accumulated energy is converted into force to be added to the moment in the same direction as that of the moment of gravity that is applied to the motor bracket 502 at the time of changing over from the downstream developing roller 201 to the upstream developing roller 101. This contributes to shorten the developing roller changeover time from the downstream developing roller 201 to the upstream developing roller 101. It is also possible to optimize the difference between the times of changing over the developing roller between both directions, by selecting initial tension and a spring constant of the coil spring 510.

In the above, the stepping motor 508 used as the driving source of the changeover mechanism can be driven in an optional frequency and can be driven in a prescribed number of driving steps. Therefore, this stepping motor can achieve more accurate changeover operation than other motor units.

Figure 5:
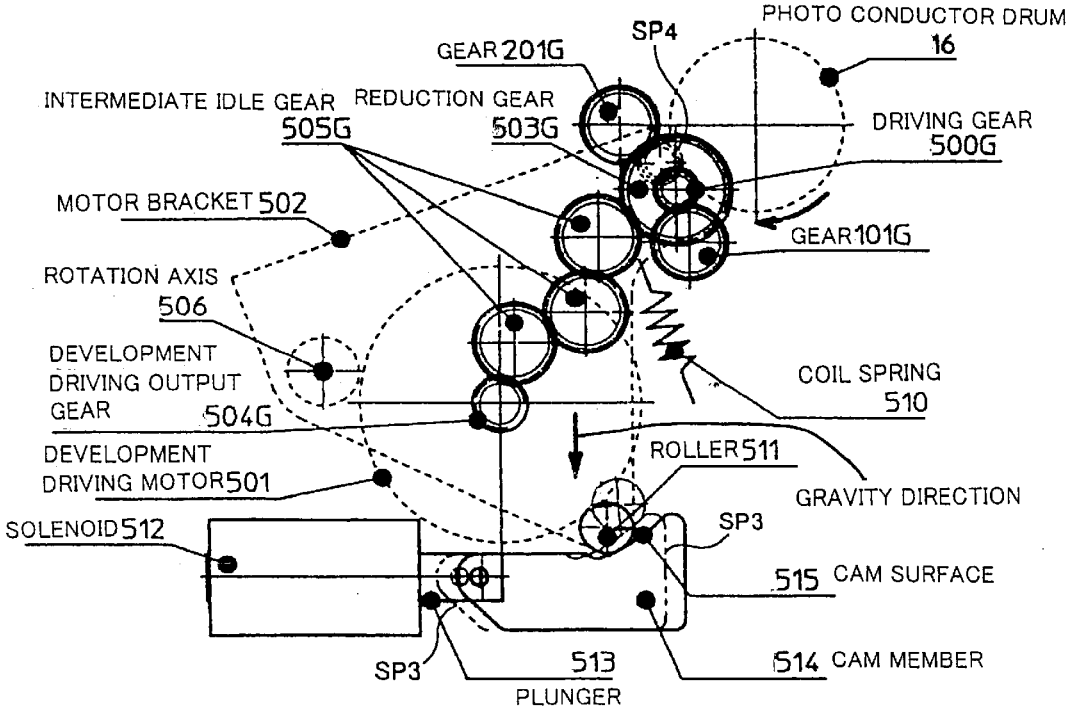
FIG. 5 is a structure diagram which shows one example of a structure capable of substantially reducing a changeover operation time, without being influenced by the performance and the like of a driving frequency changeover driving source of a stepping motor.

A structure that can substantially shorten the changeover operation time without receiving the influence of the performance of a driving frequency changeover driving source of a stepping motor. FIG. 5 is a structure diagram which shows one example of a structure capable of substantially reducing a changeover operation time, without being influenced by the performance and the like of a driving frequency changeover driving source of a stepping motor will be explained. Constituent portions in FIG. 5 that are similar to those in FIG. 4 will not be explained in detail.

At a lower end portion of the motor bracket 502, a roller 511 is rotatably supported. A solenoid 512 is fixed to the main body fixing section, and a cam member 514 is linked to a start of a plunger 513 of the solenoid 512. The cam member 514 is supported by the main body fixing section so as to be movable within a prescribed range in a plunger moving direction. The roller 511 of the motor bracket 502 is kept in contact with a cam surface 515 of the cam member 514. When the plunger 513 of the solenoid 512 moves, the motor bracket 502 rotates around a rotation axis 506 based on the move of the cam surface 515.

In the above structure, in the status that current is not conducted to the solenoid 512, the motor bracket 502 rotates by receiving the moment of gravity in the clockwise direction around the rotation axis 506. The cam member 514 moves in a direction of separating the plunger of the solenoid 512 (in the right direction in the drawing), and stops at the boundary of a prescribed moving range of the cam member (at a solid line position in the drawing).

At this time, the driving gear 500G that integrally rotates around the rotation axis with the motor bracket 502 is engaged with the gear 101G of the upstream developing roller 101. When current is conducted to the solenoid 512, the cam member 514 moves to a plunger adsorbing direction (in the left direction in the drawing), and stops at the boundary of a prescribed moving range of the cam member (at a two-point chain line position SP3 in the drawing). At this time, the motor bracket 502 rotates by receiving the moment in the counterclockwise direction around the rotation axis from the cam surface 515 that is in contact with the roller 511. The driving gear 500G is engaged with the gear 201G of the downstream developing roller 201 (at a two-point chain line position SP4 in the drawing).

In the above developing roller rotation driving force changeover operation, in order to change over from the upstream developing roller 101 to the downstream developing roller 201, it is necessary to rotate the whole motor bracket 502 against the moment of gravity. Therefore, this requires a certain level of operation time. On the other hand, it is possible to change over the developing roller from the downstream developing roller 201 to the upstream developing roller 101 in a short period of time, as the whole motor bracket 502 rotates based on only the moment of gravity. As there is no influence of the performance of the driving frequency changeover driving source of the stepping motor, it is possible to substantially shorten the changeover time as compared with the time required in the example shown in FIG. 4.

When a coil spring 510 is disposed between the motor bracket 502 and the main body fixing section to enable the motor bracket 502 to receive moment in the same direction as that of the moment of gravity, the above effect is further amplified, like the example shown in FIG. 4. It is possible to realize the changeover from the downstream developing roller 201 to the upstream developing roller 101 in a shorter period of time. On the other hand, it requires a longer period of time to change over from the upstream developing roller 101 to the downstream developing roller 201. It is also possible to optimize the difference between the times of changing over the developing roller between both directions, by selecting initial tension and a spring constant of the coil spring 510.

Figure 6:
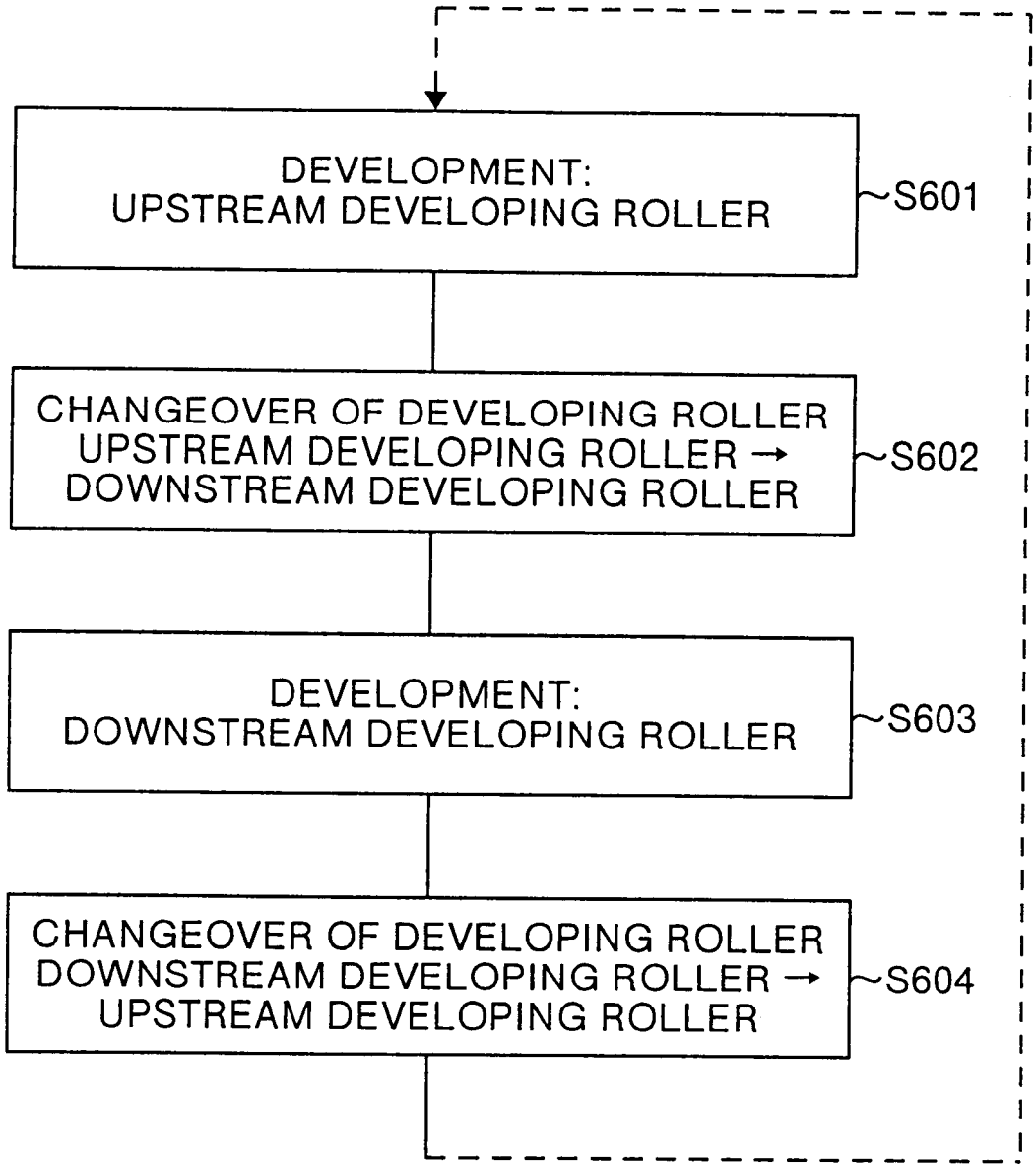
FIG. 6 is a process flow which explains one embodiment of an image formation method according to the present invention.

An image formation method that is used in the image formation apparatus of the above embodiment will be explained. FIG. 6 is a process chart which shows the image formation method according to the present invention.

According to the image formation method of the present embodiment, first a latent image on the photo conductor drum 16 is developed using the upstream developing roller 101 positioned at an upstream of the photo conductor drum 16 (step S601). At this time, the upstream developing roller 101 is in contact with the photo conductor drum 16, and coats the magenta toner on the surface of the photo conductor drum 16. Next, the developing function of the image formation apparatus is changed over from the upstream developing roller 101 to the downstream developing roller 201 over the changeover time T1 (step S602).

After the changeover, the downstream developing roller 201 is in contact with the photo conductor drum 16, coats the yellow toner, and develops the latent image on the photo conductor drum 16 (step S603) According to the image formation method of the present embodiment, after carrying out the development by using the yellow toner, the developing function is changed over from the downstream developing roller to the upstream developing roller 101 over the changeover time T2 that is shorter than the changeover time T1 (step S604).

Further, like in the above image formation apparatus, it is needless to mention that when the time required for the external periphery of the photo conductor drum 16 to move from a position in contact with the upstream developing roller 101 to a position in contact with the downstream developing roller 201 is expressed as T3, it is possible to efficiently execute the developing function changeover operation when the times T1 and T2 are in the relationship of $T2<T1<T2+2\times T3$. Further, it is possible to obtain the largest effect when the time relationship is $T1=T2+2\times T3$.

As explained above, according to the image formation apparatus and the image formation method of the present invention, two image stations are disposed around an intermediate transfer unit, and two developing units are disposed in each one photo conductor provided in each of the two image stations. The process of forming visible images of different colors on the photo conductor by changing over between the two developing units is executed for each of the two photo conductors. The visible images are sequentially transferred in superimposition onto the intermediate transfer unit. The superimposed transfer images are transferred again onto a paper to form a color image. In this image formation apparatus, the time of changing over the developing function between the two developing units is optimized. Based on this, it is possible to realize a high-speed printing, a size reduction and cost reduction of the apparatus. Further, it is possible to reduce the peripheral length of the intermediate transfer belt, thereby to reduce the size and reduce the cost of the apparatus.

The present document incorporates by reference the entire contents of Japanese priority document, 2001-159480 fileld in Japan on May 28, 2001.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image formation apparatus comprising:

an image holder, a first developing unit, and a second developing unit, wherein a latent images on the image holder is developed by changing over between the first developing unit and the second developing unit, wherein out of the first developing unit and the second developing unit, a changeover time T2 to change over from a developing unit positioned at a downstream in a rotation direction to a developing unit positioned at an upstream in the rotation direction of the image holder is set shorter than a changeover time T1 to change over a developing unit from the developing unit positioned at an upstream in the rotation direction to the developing unit positioned at a downstream in the rotation direction.

2. The image formation apparatus according to claim 1, wherein when a time required to change over a developing unit that develops a latent image on the image holder from the developing unit positioned at an upstream of the image holder to the developing unit positioned at a downstream of the image holder is expressed as T1, a time required to change over a developing unit from the developing unit positioned at a downstream to the developing unit positioned at an upstream is expressed as T2, and a time required for the external periphery of the image holder to move from a position in contact with the developing unit positioned at an upstream to a position in contact with the developing unit positioned at a downstream is expressed as T3, the time T1, the time T2 and the time T3 satisfy $T1-T2<2\times T3$.

3. The image formation apparatus according to claim 1, further comprising a single driving unit that rotation-drives the first and second developing units, and a changeover unit that changes over a power transfer destination of the driving unit to any one of the first developing unit and the second developing unit.

4. The image formation apparatus according to claim 3, wherein at the time of changing over a developing unit that develops a latent image on the image holder from the developing unit positioned at an upstream of the image holder to the developing unit positioned at a downstream of the image holder, the changeover unit accumulates energy that can be converted into driving force that is to be utilized in the operation of changing over from the developing unit positioned at a downstream to the developing unit positioned at an upstream.

5. The image formation apparatus according to claim 4, wherein the energy that is accumulated at the time of changing over a developing unit that develops a latent image on the image holder from the developing unit positioned at an upstream of the image holder to the developing unit positioned at a downstream of the image holder is accumulated according to gravity.

6. The image formation apparatus according to claim 4, wherein the energy that is accumulated at the time of changing over a developing unit that develops a latent image on the image holder from the developing unit positioned at an upstream of the image holder to the developing unit positioned at a downstream of the image holder is accumulated according to spring force.

7. The image formation apparatus according to claim 4, wherein the changeover between the first developing unit and the second developing unit is carried out by a stepping motor.

8. The image formation apparatus according to claim 4, wherein the changeover between the first developing unit and the second developing unit is carried out by a solenoid.

9. An image formation method executed on an image formation apparatus that comprises a first developing unit and a second developing unit, and that develops latent images on an image holder using the first developing unit and the second developing unit, the image formation method comprising:

developing a latent image on the image holder using a developing unit positioned at an upstream in the rotation direction of the image holder, out of the first developing unit and the second developing unit;

changing over a developing unit used for development from a developing unit positioned at an upstream in the rotation direction of the image holder to a developing unit positioned at a downstream in the rotation direction of the image holder over a changeover time T1;

developing a latent image on the image holder using the developing unit positioned at a downstream in the rotation direction of the image holder; and changing over a developing unit used for development from the developing unit positioned at a downstream in the rotation direction of the image holder to the developing unit positioned at an upstream in the rotation direction of the image holder over a changeover time T2 that is shorter than the changeover time T1.

* * * * *